US006711919B1

(12) United States Patent
Arnold et al.

(10) Patent No.: US 6,711,919 B1
(45) Date of Patent: Mar. 30, 2004

(54) METHOD FOR PRODUCING MULTIAXIAL WARP KNIT FABRIC

(75) Inventors: Rolf Arnold, Dresden (DE); Evelin Hufnagl, Pima (DE); Jens Stopp, Niederlungwitz (DE); Franco Puffi, Lugano (CH); Patrizio Sfregola, Poglianc Milanese (IT)

(73) Assignee: Textilma AG, Hergiswil (CH)

( * ) Notice: Subject to any disclaimer, the term of this patent is extended or adjusted under 35 U.S.C. 154(b) by 493 days.

(21) Appl. No.: 10/009,871

(22) PCT Filed: Jun. 9, 2000

(86) PCT No.: PCT/CH00/00316

§ 371 (c)(1),
(2), (4) Date: Dec. 11, 2001

(87) PCT Pub. No.: WO01/00914

PCT Pub. Date: Jan. 4, 2001

(30) Foreign Application Priority Data

Jun. 23, 1999 (DE) ..... 199 28 635

(51) Int. Cl.[7] ..... D04B 23/12
(52) U.S. Cl. ..... 66/84 A; 66/195; 66/192

(58) Field of Search ..... 66/192, 195, 193, 66/196, 190, 171, 169 R, 84 A, 84 R, 83, 203; 442/304, 305, 306, 308, 312, 313, 314, 318

(56) References Cited

U.S. PATENT DOCUMENTS

| | | | | | |
|---|---|---|---|---|---|
| 4,518,640 | A | * | 5/1985 | Wilkens | 66/192 |
| 4,703,631 | A | * | 11/1987 | Naumann et al. | 66/84 A |
| 4,845,963 | A | * | 7/1989 | Parekh | 66/193 |
| 5,809,805 | A | * | 9/1998 | Palmer et al. | 66/190 |
| 6,233,978 | B1 | * | 5/2001 | Gehring et al. | 66/195 |

* cited by examiner

*Primary Examiner*—Danny Worrell
(74) *Attorney, Agent, or Firm*—Ostrolenk, Faber, Gerb & Soffen, LLP

(57) ABSTRACT

A method for producing multiaxial warp knit fabrics with extended threads in longitudinal, transverse and diagonal directions as a result of direct insertion of the diagonal threads as weft sections onto backs of rising needles of needle bars. The method includes simultaneously inserting at least two diagonal thread systems contrarily as part wefts for each needle bar on a right/right warp knitting machine.

7 Claims, 2 Drawing Sheets

METHOD FOR PRODUCING MULTIAXIAL WARP KNIT FABRIC

PRIORITY CLAIM

This is a U.S. national stage of application No. PCT/CH00/00316, filed on Jun. 9, 2000. Priority is claimed on that application and on the following application: Country: Germany, Application No: 199 28 635.3, Filed: Jun. 23, 1999.

BACKGROUND OF THE INVENTION

The production of multiaxial warp knit fabrics by the incorporation of reinforcing threads as weft, warp and diagonal threads is already known. DE-A 33 04 345 describes, for example, a warp knit cloth with a normal warp knit fabric as the cloth ground and with reinforcing threads inserted into the latter. Weft threads run parallel to one another and are arranged in each case between two stitch heads of successive stitch rows and, in addition, two sets of diagonal threads are provided, which in each case run alternately between two stitch heads of stitch rows succeeding one another in the knitting direction. In this version, there are in the warp, weft and diagonal directions reinforcing threads which are not pricked through by the knitting needles. All the reinforcing threads are arranged at an angle of 45° to one another, which, however, as a consequence of the method cannot be modified.

1. Technical Field

The invention relates to a method for the production of multiaxial warp knit fabrics with extended threads in the longitudinal, transverse and diagonal directions as a result of the direct insertion of the diagonal threads as weft sections onto the backs of the rising needles. The textile structures produced by the method are used, by virtue of their high stability and strength in the various directions, as reinforcement in composite materials, for example in automobile construction, rail vehicle construction and the aeronautic industry.

2. Prior Art

The production of multiaxial warp knit fabrics by the incorporation of reinforcing threads as weft, warp and diagonal threads is already known. DE-A 33 04 345 describes, for example, a warp knit cloth with a normal warp knit fabric as the cloth ground and with reinforcing threads inserted into the latter, in which weft threads run parallel to one another and are arranged in each case between two stitch heads of successive stitch rows and, in addition, two sets of diagonal threads are provided, which in each case run alternately between two stitch heads of stitch rows succeeding one another in the knitting direction. In this version, there are in the warp, weft and diagonal directions reinforcing threads which are not pricked through by the knitting needles. All the reinforcing threads are arranged at an angle of 45° to one another, which, however, as a consequence of the method cannot be modified.

A special warp knitting machine for the processing of multiaxial contextures is also known, in which up to seven thread plies are suspended in a transport chain (90°/± diagonal/90°/−diagonal/90°/+diagonal/90°) and are consolidated in the region of the knitting point by means of a warp knit weave. A 0° thread system may be laid in place as the last thread ply directly in front of the knitting point. However, the knitting operation makes it necessary to prick through the closely layered thread plies, thus leading to the displacement of the threads. The consequences of this are a reduction in the cloth strength and an uneven defective structure density (Melliand Textile Reports 11/86, pages 804 to 806).

By means of the stitch-bonding machine, Malimo type, with multiaxial weft insertion, it is possible to produce multiaxial knit fabrics, for example with a thread ply combination of 0°/−90°/−45°/−90°/±45° in the case of angular deviations of 1 to 5°, that is to say the weft threads are not exactly parallel (Kettenwirk-praxis [Warp Knitting Practice] 2/94, pages 15 to 17).

In the multiaxial knitting technique for the production of industrial textiles on a right/left flat knitting machine, the multiaxial thread insertion is carried out by means of a combination of threads in the directions 0°/90°/±45° (ITB Vliesstoffe—technische Textilien [ITB nonwoven textiles] 1/95, pages 44 to 45). The particular feature of this knitted fabric is that the threads running diagonally and vertically (0°) alternate after every second row on the front side and rear side of the cloth. The thread run for the warp threads and diagonal threads from the front side to the rear side of the sheetlike structure is implemented by additional drives for the feed elements, one for controlling the crossing movement and one for controlling the racking movement, which is executed it a revolving manner. This tying-in technique is intended primarily to prevent the delamination which occurs it the case of composite materials.

A biaxial knitting technique and a biaxially reinforces multiply knitted fabric are known from DE 49 19 985 A1. Altogether five weft systems can be inserted at right angles with crossing (90°/0°/90°/0°/90°) on a right/right flat knitting machine. Due to the arrangement of the thread plies (0°/°90°), it is not possible to produce multiaxial knitted fabrics. Moreover, the 0° thread plies are pricked through by the emerging needles, thus leading to the same disadvantages as in the special warp knitting machine.

Furthermore, several patent specifications (DD 268 720, DD 268 721, DD 258 722, DD 268 723, DD 268 729, DD 256 885) disclose variants for the production of multiaxial devices, in particular for stitch-bonding machines, by means of which an improvement in the quality of multiaxial sheetlike structures at a reduced mechanical outlay and a variable configuration due to the feed of finite thread sections from thread storage cartridges are to be achieved.

In the techniques which work on the basis of presented thread groups, as a consequence of the principle the 0° thread plies always form the covering layer, with the result that the isotropy of the composite structure is impaired in the case of the multiply structures to be achieved. Some of the known multiaxial structures possess thread systems crossing at right angles, which cannot satisfy the requirements as to fiber angles (no greater than 45°) the known devices for the insertion of thread groups into transport chains make it possible to vary the guide angle of the diagonal threads within certain limits, but not when the machine is running.

SUMMARY OF THE INVENTION

The object of the present invention is to provide a method for the production of knitted reinforcing structures with a multiple variable multiaxial thread run, by means of which the thread angle can be changed as a function of the required force line runs, with the machine running, in the region of the diagonal and 90° threads. At the same time, the pricking through of thread plies or the pricking on of threads is to be avoided, in order to ensure cost-effective production.

Pursuant to this object, and others which will become apparent hereafter, one aspect of the present invention resides in a method for the production of multiaxial warp knit fabrics with extended threads in the longitudinal, transverse and diagonal directions as a result of the direct insertion of the diagonal threads as weft sections onto the backs of the rising needles of the needle bars. At least two diagonal thread systems are simultaneously inserted contrarily as part wefts for each needle bar on a right/right warp knitting machine.

In another embodiment, 0° threads are inserted as upright wefts between the diagonal thread systems.

In yet another embodiment of the invention 90° threads are simultaneously inserted as through wefts in line with the stitch rows. The 90° threads, in still a further embodiment, are partially discontinued or continue to operate as a part weft.

In an additional embodiment of the invention 0° threads are additionally run in, and are racked laterally at a distance from one another.

In still another embodiment, the diagonal threads are discontinued according to the pattern and run as 0° threads.

The advantages achieved by nears of the invention are, in particular, that, by means of the right/right warp knitting machine, weft insertion in line with the stitch rows can take place, while, due to the simultaneous contrary insertion of the diagonal threads on the front and rear needle bar, four diagonal thread systems for each complete stitch row can be tied in at a low outlay. Another advantage is that the 0° threads are fed and tied in directly between the contrarily moved weft threads. The pricking through of the threads is ruled out in this procedure, so that a better utilization of substance is possible, as compared with multiaxially knitted contextures. By virtue of the direct weft insertion, there is no need for a prior production of the contexture (suspension of the thread groups inserted at an angle in the transport chains), so that there is a direct control of the racking distance of the weft threads in the region of the knitting zone. It is thereby possible to change the guide angle of the diagonal threads according to the force lines. 90° threads may likewise be brought, as desired, into a 0° position, with the result that differentiated layer thicknesses can be produced in a varying sequence.

Moreover, by means of the tying elements of a coarse three-dimensional right/right warp knit structure, the multiaxially layered threads are substantially reinforced in the z-direction and consequently the resistance to delamination is improved considerably.

BRIEF DESCRIPTION OF THE DRAWINGS

An exemplary embodiment of the invention is illustrated in the drawing and is described in more detail below. In the drawing.

PREFERRED EMBODIMENTS

Figure 1:
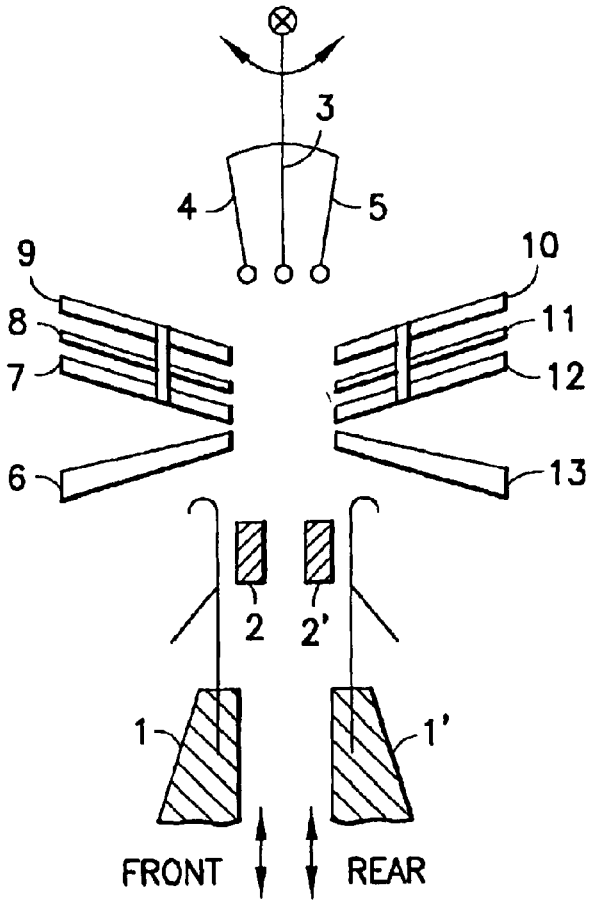
FIG. 1 shows a diagrammatic illustration of the knitting point of a right/right warp knitting machine for carrying out the method according to the invention.

According to the section illustrated in FIG. 1, the knitting point of a right/right warp knitting machine is formed by a front and rear needle bar 1, 1' with knitting needles and with the associated knockover edges 2, 2' and the thread guide members. The thread guide members consist of at least one oscillating ground guide rail 3, which carries out insertion for stitch formation 3', 3" on the front and rear needle bar 1, 1', and of at least one oscillating weft guide rail 4, 5, which is assigned to the front and rear needle bar 1, 1' and via which additional 0° weft threads (4', 5') run in, which, if required, are racked laterally. The thread guide members consist, furthermore, of nonoscillating thread guides 6 to 13. The thread guide 6 is assigned to the front needle bar 1 and inserts a 90° thread system 6' which is tied off in the region of the front needle bar 1 by the ground threads 3' by means of the guide rail 3. The thread guide 6 tray also be discontinued or may guide only over part distances, depending on the force line run. The thread guides 7 and 9 are provided for the insertion of diagonal threads 7', 9' and are designed, for example, as small tubes and are arranged on an oscillating or rotating driving device, at the spacing of the needle division, over the entire working width. After the respective cloth edge has been reached, the thread guides 7 travel into the position of the thread guides 9 and the thread guides 9 travel into the position of the thread guides 7. In this case, the racking length for each stitch row depends on the desired insertion angle of the diagonal threads 7', 9'. If required, the diagonal threads 7', 9' may also be discontinued according to the pattern and run as 0° threads.

The rigidly arranged thread guide 8 is provided for feeding the 0° threads 8' which lie between the diagonal threads 7' and 9' in the knit fabric. The thread guides 10 to 13 are assigned to the rear needle bar 1'. The rear diagonal threads 10' and 12' are inserted by the thread guides 10 and 12, the insertion principle corresponding to that of the thread guides 7 and 9.

The rear 0° threads 11' are inserted between the diagonal threads 10' and 12' by rigidly arranged thread guides 11 in a similar way to the threads 8'. The thread guide 13 inserts the rear 90° thread system 13', while, as in the case of the thread guide 6, discontinuation or insertion over part distances may also take place.

Figure 2:
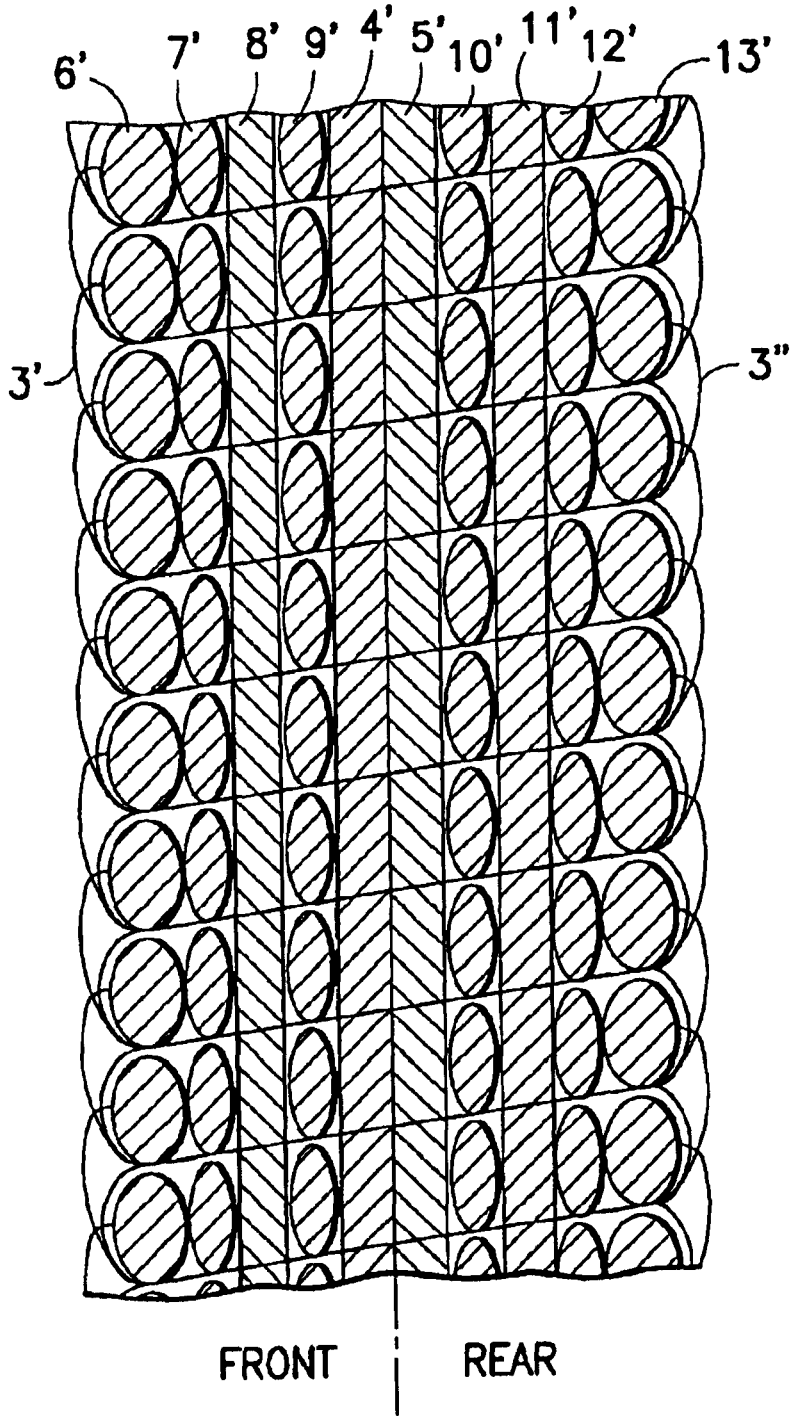
FIG. 2 shows a section through a right/right warp knit fabric according to FIG. 1.

The method according to the invention results, according to FIG. 2, in the following arrangement of the thread plies in the knit fabric: 90°; –diagonal; 0°; +diagonal; 0° with racking according to the pattern; 0° with racking according to the pattern; –diagonal; 0°; –diagonal; 90°. The insertion angles of the diagonal threads 7' and 9' or 10' and 12' can be modified by the lengthening or shortening of the underlay length for each stitch row.

Figure 3:
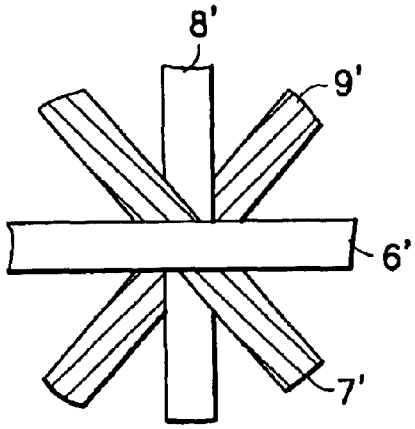
FIG. 3 shows a diagrammatic illustration of a top view of the right/right warp knit fabric according to the detail in FIG. 2

FIG. 3 illustrates z crossing point of four thread systems 6', 7', 8' and 9' on the front needle bar 1 . Accordingly, the 90° threads 6' lie in front of the diagonal threads 7' and 9' and the 0° threads 8' run between the diagonal threads 7 ', 9'.

The 90° threads, diagonal threads and 0° threads are arranged in a similar way on the rear needle bar 1' having the thread systems 10', 11', 12' and 13', the crossing points of the front thread systems and of the rear thread systems being arranged so as to be offset to one another according to the right/right knit fabric structure.

By means of the method according to the invention, multiaxial structures with a specific force line run in all directions can be produced optimally for a multiplicity of fields of use.

What is claimed is:

1. A method for producing multiaxial warp knit fabrics with extended threads in longitudinal, transverse and diagonal directions as a result of direct insertion of the diagonal threads as weft sections onto backs of rising needles of needle bars, comprising the step of simultaneously inserting at least two diagonal thread systems oppositely as part wefts for each needle bar on a right/right warp knitting machine.

2. A method according to claim 1, including inserting 0° threads as upright wefts between the diagonal thread systems.

3. A method according to claim 1, including simultaneously inserting 90° threads as through wefts in line with the stitch rows.

4. A method according to claim 3, wherein the 90° threads are partially discontinued to form a part weft.

5. A method according to claim 3, wherein the 90° threads continue to operate as a part weft.

6. A method according to claim 1, further including additionally running in 0° threads which are racked laterally at a distance from one another.

7. A method according to claim 1, including discontinuing the diagonal threads according to a pattern and running the diagonal threads as 0° threads.

* * * * *